United States Patent [19]

Beierwaltes et al.

[11] 4,263,736

[45] Apr. 28, 1981

[54] MODULAR DISPLAY SYSTEM

[75] Inventors: William T. Beierwaltes; Donald P. Aupperle; William J. Nicolay, all of Loveland, Colo.

[73] Assignee: Colorado Time Systems, Inc., Loveland, Colo.

[21] Appl. No.: 950,350

[22] Filed: Oct. 11, 1978

[51] Int. Cl.[3] ..... G09F 3/04

[52] U.S. Cl. ..... 40/452; 40/451; 40/573; 40/574; 40/576; 340/323 R; 340/366 G; 340/378.2; 340/756

[58] Field of Search ..... 40/442, 447, 450, 451, 40/463, 452, 573, 575, 574, 576, 571, 605; 340/323 R, 366 G, 378.1, 378.2, 378.5, 378.6, 381, 752, 756; 273/1 U

[56] References Cited

U.S. PATENT DOCUMENTS

| | | | |
|---|---|---|---|
| 2,499,049 | 2/1950 | Yates | 40/576 |
| 2,623,111 | 12/1952 | Chervenka et al. | 340/323 R |
| 2,632,270 | 3/1953 | Moss | 40/576 X |
| 3,104,484 | 9/1963 | Wood | 40/452 |
| 3,197,904 | 8/1965 | Holcomb | 40/452 |
| 3,309,577 | 3/1967 | Roll, Jr. | 340/378.1 |
| 3,362,093 | 1/1968 | Joselevich | 40/452 |
| 3,382,495 | 5/1968 | Christy | 340/378.2 |
| 3,440,537 | 4/1969 | Warner et al. | 340/378.1 |
| 3,484,974 | 12/1969 | Culmone | 40/618 |
| 3,553,870 | 1/1971 | Rudolph | 40/576 |
| 3,685,186 | 8/1972 | Goodman | 40/576 X |
| 3,742,633 | 7/1973 | Palm | 40/576 |
| 3,864,861 | 2/1975 | Hill, Jr. | 40/576 |

*Primary Examiner*—John F. Pitrelli
*Assistant Examiner*—G. Lee Skillington
*Attorney, Agent, or Firm*—Robert C. Dorr

[57] ABSTRACT

A modular display system having a plurality of display modules, a plurality of display signs, a plurality of insertable digit panels, a plurality of insertable spacer panels, and one or a plurality of insertable colon panels. The display system is mounted to a wall and can be reconfigured as different predetermined configurations both as to the number of signs and modules. Each module can be changed to a variety of predetermined configurations. A thumbwheel switch is provided on each module so that with each different configuration, a different setting is entered on the thumbwheel switch thereby reconfiguring control information to display the data properly on each module.

6 Claims, 22 Drawing Figures

A
B
C
D
E
F
G
H

2100
PROCESSOR
LATCH
ROM
2110
2120
2144
2146
2148
2152
2154
2150
2160
2130
2132
2134
2136
2138
2142
+5V
1800
2170
2156
2140
DECODER

MODULAR DISPLAY SYSTEM

BACKGROUND OF THE INVENTION

1. Field of the Invention

The present invention relates generally to display systems and more particularly to modular scoreboard display systems.

2. Description of the Prior Art

It is generally well known that traditional scoreboards are heavy and bulky and once installed it is difficult to move or to modify them. Furthermore, traditional scoreboards are difficult to maintain and when a breakdown occurs, the entire system is usually disabled for the duration of the problem. Furthermore, such traditional scoreboards are uniquely designed for each different sport, and, hence, most schools and universities can only afford scoreboards for their several major sports.

In order to ascertain the prior art in this field, the Inventors effectuated a patentability search to be performed resulting in the following prior art:

| Inventor | U.S. Pat. No. | Date |
|---|---|---|
| Spencer | 2,978,676 | April 4, 1961 |
| Spencer et al | 3,440,347 | April 22, 1969 |
| Clift | 3,588,869 | June 28, 1971 |
| Abbott | 3,651,507 | March 21, 1972 |
| Hurley | 3,653,026 | March 28, 1978 |
| Kurtenback | 3,727,213 | April 10, 1973 |
| Sweeney | 3,737,889 | June 5, 1973 |
| Syria | 3,959,640 | May 25, 1976 |
| Gardner | 3,981,002 | September 14, 1976 |
| Castelli et al | 4,045,788 | August 30, 1977 |

The Gardner patent relates to a portable scoreboard including a keyboard which is adapted for use with a variety of events. The patent to Castelli is directed to an allpurpose scoreboard for a variety of sporting events wherein a radio transmitter is used. The Clift patent sets forth an automatic scoring system for scoring vehicles using radio transmitters on each of the vehicles. The Hurley patent displays a bingo scoring system using a remote transmitter and the Abbott approach is directed to a remote control device for turning off the scoreboard clock. The Sweeney patent sets forth a display system for boxing matches, the Syria patent sets forth an electronic computer and display system for a variety of different athletic events, and the Kurtenback patent sets forth a portable scoreboard for use adjacent a wrestling match.

However, all the above approaches, however diverse they may be, do not provide a truly versatile scoreboard which is totally functional and modular as does the present invention. The display of the present invention includes a plurality of modules and a plurality of signs which can be interchanged in any number of predetermined formats adaptable to any number or variety of sports. Furthermore, each module contains a plurality of sliding digits, a plurality of spacer panels, and one or a plurality of colon panels. These can be selectively inserted into the module to define a number of predetermined configurations of numeric or alphabetic patterns. In order to accomplish this versatility, a separate electronic control is provided on each module and whenever a different display is desired at the module, the information is appropriately modified. The system is designed so that should any portion thereof fail, that portion can be quickly and easily removed. Finally, each module contains the ability to conduct a self-test of its operation independent from each other module and independent from the system. Should any portion of the module fail, that portion can be quickly and easily replaced.

OBJECTS OF THE INVENTION

It is an object of this invention to provide a new and novel display system adaptable to any number of applications.

It is another object of the present invention to provide a new and novel sports scoreboard system which includes a plurality of display modules and a plurality of display signs adaptable to be configured in a variety of arrangements.

It is another object of the present invention to provide a new and novel display system wherein each display module can be reconfigured into a variety of different configurations.

It is a further object of the present invention to provide a new and novel sports scoreboard system wherein each module can be reformatted, electronically, by means of a thumbwheel setting to activate the reconfigured display.

It is a further object of the present invention to provide a new and novel display system wherein each module can be independently tested from the other modules in the system.

SUMMARY OF THE INVENTION

The sports scoreboard display system of the present invention includes a plurality of display modules and a plurality of display signs.

The display modules are independently mounted onto a bracket arrangement so that each display module can be independently and randomly removed without interfering with the other mounted display modules. Furthermore, each display module includes a plurality of sliding alphanumeric digits, a plurality of spacer panels, and one or a plurality of colon panels. The sliding digit, blank, and colon panels can be arranged to produce a variety of different display configurations. For each different display configuration, a thumbwheel on the display module is set to a new setting corresponding to that configuration. Hence, the electronic control activating the alphanumeric display is modified to correspond to the arranged configuration. Self test positions are provided on the thumbwheel switch on each module and when thrown, different test patterns to check the integrity of the module are generated.

The display holder is mounted to the modules and includes a rigid member with parallel rows of attachment material to which can be mounted a variety of different signs.

Other objects, advantages and capabilities of the present invention will become more apparent as the description proceeds taken in conjunction with the accompanying drawings.

DETAILED DESCRIPTION

Figure 1:
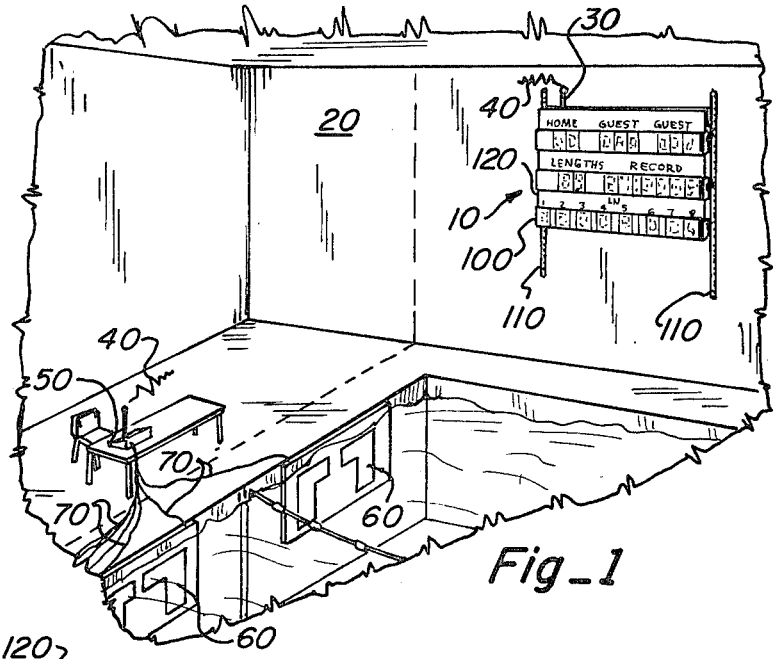
FIG. 1 sets forth in perspective view the modular display system 10 of the present invention in application as a display for a swim meet, FIG. 2 sets forth a rearrangement of the display shown in FIG. 1.

The display system 10 of the present invention is shown in FIG. 1 mounted in a typical environment. The display system 10 is mounted to a wall 20 of a swimming area. The display system receives digital information by means of, for example, an antenna 30 which picks up radio waves 40 from a transmitter 50 located on the floor of the swimming area. The transmitter 50 receives information from a variety of sources including touch pads 60 over cables 70.

In the configuration shown in FIG. 1, the display system 10 is set up to use three separate display modules 100 and three display signs 120. Each display module 100 is mounted to opposing mount brackets 110. In this configuration, the first display sign 120 sets forth the words "HOME", "GUEST", and "GUEST". The first display module 100 directly below the first display sign sets forth two digits beneath each of the above words in order to display the overall score by the appropriate team. The second display sign 120 sets forth the words "LENGTH" and "RECORD". The second display module 100 is configured to display the above-identified information. Finally, the display system sets forth the lane by lane finishing of the swimmers.

Figure 2:
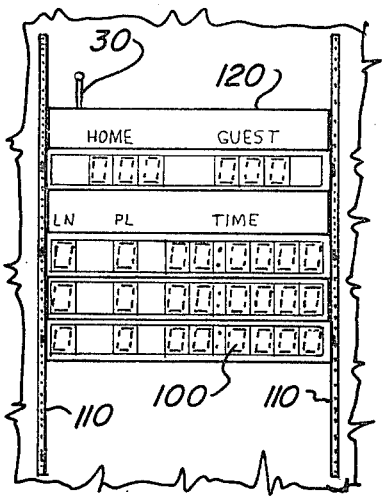

Under the teachings of the present invention, and as will become apparent in the following, the display system as shown in FIG. 1 can be easily modified and changed to a different order as shown in FIG. 2. It is to be noted that FIG. 2 sets forth four display modules 100 thereby necessitating an additional display module 100 to be mounted to the opposing mounting brackets 110. Furthermore, each individual display module 100 has been modified as shown in FIG. 2 to a new configuration. In the arrangement of FIG. 2, only two display signs 120 are used and with different wordage.

Figure 3:
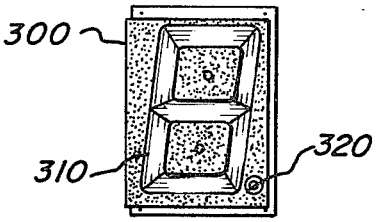
FIG. 3 is a front planar view of a sliding digit of the present invention.
Figure 4:
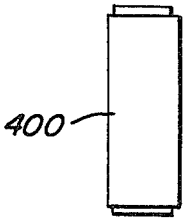
FIG. 4 is a front planar view of a sliding spacer panel of the present invention.
Figure 5:
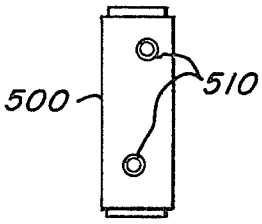
FIG. 5 is a front planar view of a sliding colon panel of the present invention.
Figure 9:
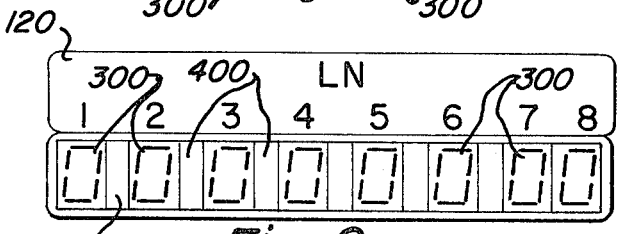
FIG. 9 is a representation of one configuration of a module of the present invention showing lane placing.

This is accomplished by using three different types of sliding and selectively insertable panels as shown in FIGS. 3–5. For example, in FIG. 3 is a rectangular shaped sliding digit 300 which is capable of producing an alphanumeric display for a plurality of seven segments 310 as shown. Furthermore, a period light 320 is provided on the sliding digit panel 300. Alphanumeric digit arrangements are known in the art and may comprise, for example, the type disclosed in co-pending patent application Ser. No. 730,643. A second type of panel as shown in FIG. 4 is termed a spacer panel 400 and comprises no information and is of the same vertical size but substantially one-half of the horizontal width as the sliding digit panel 300 shown in FIG. 3. Finally, a third type of panel is shown in FIG. 5 and is termed a sliding colon panel 500 and comprises two circular dots 510 which form a colon. Of course, when any of the segments 310, light 320, or colon 510 are not lit they appear as a blank. The blank and colon panels 400 and 500 are made of plastic and are flexible whereas the sliding digit panel is rigid.

Under one embodiment of the present invention, eight sliding digit panels 300 are inserted into each module 100 at the factory. The customer receives five spacer panels 400 and one colon panel 500. The customer can then selectively and easily insert panels 400 and 500 into the module 100 to arrive at any of the configurations shown in FIGS. 6–9 (and a host of others).

Figure 6:
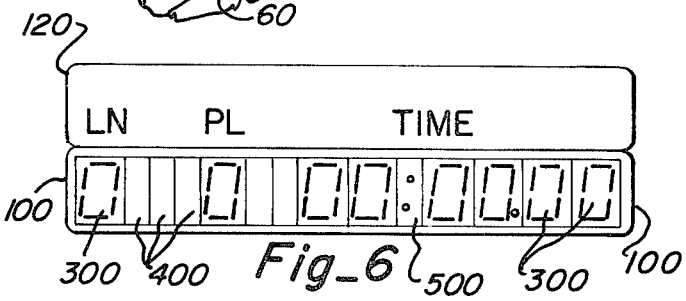
FIG. 6 is a representation of one configuration of a module of the present invention showing lane, placing, and time.
Figure 7:
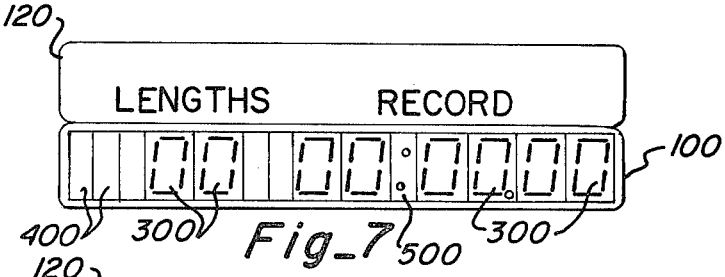
FIG. 7 is a representation of one configuration of a module of the present invention showing length and record time.

In FIG. 6, the top display sign 120 is modified to set forth the lane number, the finish place and the running time. The first display panel 100 has the three panels 300, 400, and 500 of the present invention configured to place one alphanumeric digit 300 below the "LN" position, followed by two blank panels 400 and a second alphanumeric digit 300 below the "PL" position followed by two more blank panels 400. Finally, the remaining sliding digits 300 are configured in conjunction with a colon panel 500 to provide sufficient number of alphanumeric digits to set forth the time. In a similar fishion, FIG. 7 is configured to set forth the LENGTHS and RECORD times of a swimmer. The lengths, for example, are automatically advanced when the lead swimmer activates the touch pad 60. The record time is entered from the keyboard of the transmitter 50. In this configuration, two spacer panels 400 are first inserted followed by two sliding digit panels 300 followed by two spacer panels 400 and then a time configuration.

The display panel 100 as discussed above is an alphanumeric device. It is to be expressly understood that the display panel 100 can embrace a number of different patterns including, but not limited to, star-burst patterns, dot-matrix patterns, clock exchange symbols, foreign language configurations, and other commercial and scientific symbols.

Figure 8:
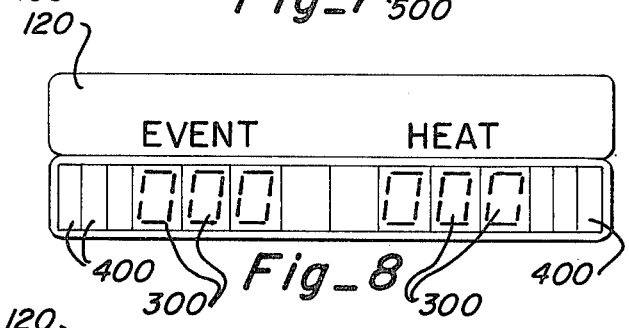
FIG. 8 is a representation of one configuration of a module of the present invention showing the event and heat.

In FIG. 8, the display panels 100 are configured to set forth the EVENT and HEAT information which are both entered from the keyboard. In this arrangement three spacer panels 400 are first inserted followed by three sliding digit panels 300 for the EVENT information followed by two sliding digit panels 300 and the colon panel 500 *which are not activated* (and thus serve as blanks). The HEAT information is provided by three sliding digit panels followed by three spacer panels 400.

Figure 10:
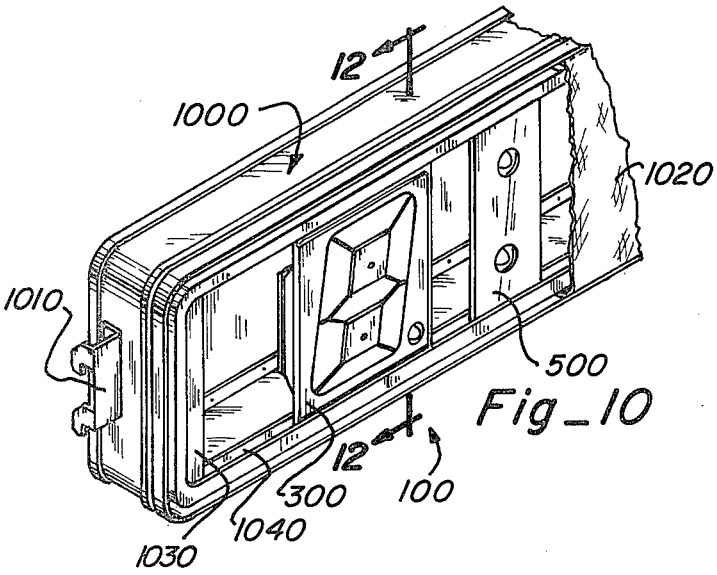
FIG. 10 is a partial perspective view of a module of the present invention.

In FIG. 10 is shown a perspective view of a display module 100 having an outer frame or housing 1000, attached to the outer housing, a mounting bracket 1010, a contrast screen 1020 mounted to the front of frame 1000, and a filler plate 1030. The sliding panels engage the housing 1000 and can be slid in either direction in channel 1040. In FIG. 10, only two panels 300 and 500 are shown.

Figure 11:
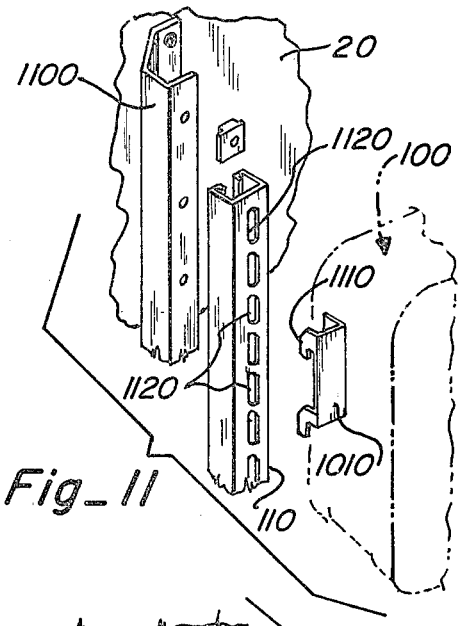
FIG. 11 is a perspective view illustrating how the module of the present invention is affixed to the wall.

FIG. 11 sets forth details of mounting a display module 100 to the wall 20. A UNISTRUT* channel 110 is affixed to the wall by conventional means such as a wall bracket 1100. As shown in FIG. 1, the UNISTRUT channels 110 are mounted parallel to each other on the wall 20 at opposing ends of the display panels 10. Bracket 1010 has two opposing and extending clips 1110 which engage corresponding slots 1120 in the UNISTRUT channels 110. Therefore, when the display panel 100 is mounted to the UNISTRUT panels 110, the display panel 100 is held firmly against the wall 20 due to the engagement of the clips 1110 through the holes 1120 and the interior of the channels 110. When mounted, the module 100 is spaced about five inches from the wall 20.

*UNISTRUT, a trademark of Unistrut Corp.

While the above sets forth a wall-mount arrangement, the present invention is not limited to such an approach and may be constructed to embrace a portable housing for use, for example, in a classroom or any other environment.

Figure 12:
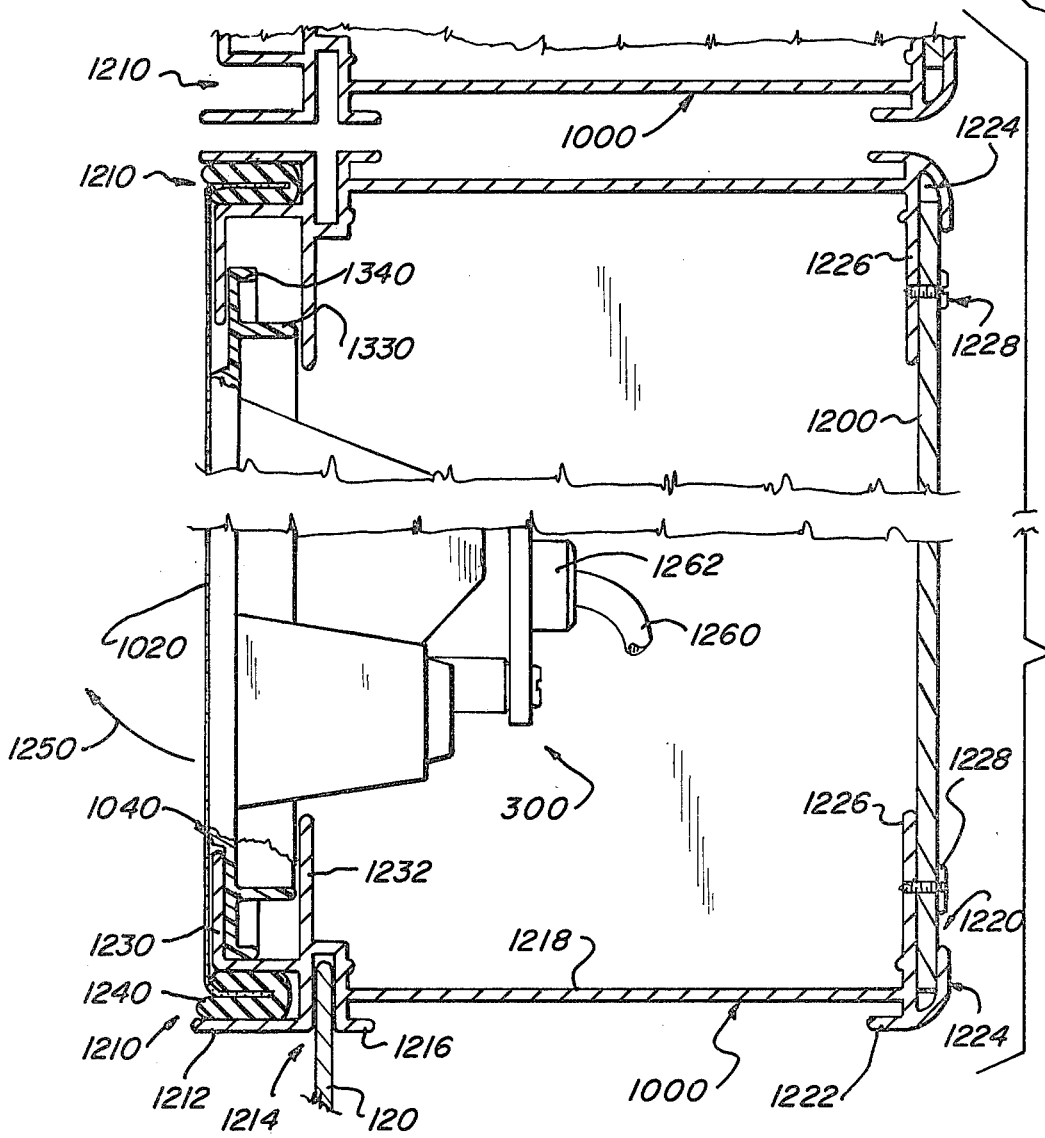
FIG. 12 is a cross-sectional view of a module of the present invention having a sliding digit placed therein.

FIG. 12 sets forth, in cross-sectional view, the construction of frame 1000 and the engagement with the frame 1000 by the sliding digit 300. The housing 1000 is formed from warp-around extruded aluminum. The rear of the housing comprises a plastic substantially rectangular plate 1200.

The extruded aluminum frame 1000 has the following symmetrical configuration as shown in FIG. 12. An outwardly directed channel 1210 is opened at one end and is substantially rectangular in shape. The outer surface 1212 of channel 1210 is substantially flat and extends rearwardly of the housing 1000 to engage an upwardly-directed channel 1214 which is spaced rearwardly from channel 1210 and perpendicular thereto. Channel 1214 is also substantially rectangular in shape as shown in FIG. 12 Surface 1212 continues on the other side of channel 1214 rearwardly of the housing 1000 with surface 1216. Substantially at the midposition of channel 1214 extending rearwardly is a flat horizontal extruded portion 1218 which forms the top, bottom, and side walls of the housing 1000. The extruded wall portion 1218 terminates in a rearwardly formed extrusion which forms an upwardly directed channel 1220 which is parallel to channel 1214. At the bottom of channel 1220 is a flat horizontal resting surface 1222 which extends rearwardly of the housing 1000 to form an arc terminating in a vertical flat surface 1224. As can be seen, in FIG. 12, the back plastic plate 1200 engages the channel 1224 both on the top and the bottom of the housing 1000 and is firmly affixed to an upward and inwardly extending plate 1226 by means of a screw 1228. Hence, as can be seen in FIG. 12, with reference to FIG. 10, the extruded aluminum frame is configured in a wrap-around assembly so that the top and bottom portions are symmetrical with respect to each other and so are the two opposing sides of the display panel 100.

The upper wall of channel 1210 terminates in an upwardly extending front plate 1230 and is parallel to a corresponding upward plate 1232 disposed at the opposite edge of the channel 1210. As can be seen in FIG. 12, the height of plate 1232 is greater than the height of plate 1230. Plates 1230 and 1232 form the channel 1040 which is receptive of the channels 300, 400 and 500.

The contrast screen 1020 is mounted across the face of the housing 1000 by means of an insert material known as TRIM-LOCK which is plastic coated spring steel 1240 which is fixedly attached to the edge of the screen 1020. As seen in FIG. 12, the insert material 1240 is pressedly inserted into channel 1210 which surrounds the periphery of the front space of the housing 1000 and firmly and snugly holds the contrast screen 1020 in a taut condition across the entire front of the housing 1000 thereby substantially concealing the sliding panels 300, 400 and 500. It is only when the alphanumeric displays 300 are lighted that the corresponding information can be readily and visibly seen through contrast screen 1020.

As will be discussed more fully later, the contrast screen 1020 can be easily removed by pulling the insert material outwardly from the channels 1210. Each digit panel can be removed by moving each panel upwardly into the uppermost channel 1040 and then swinging the bottom edge of the sliding panels in the direction of arrow 1250. The cord 1260 is attached to the interior of the frame 1000 to the display 300 by a plug 1262 or the like. Therefore, the alphanumeric unit can be easily removed from the interior of the housing 1000. In the preferred embodiment, however, the sliding digits are installed at the factory and the customer reconfigures the display module 100, as previously discussed, by inserting spacer and colon panels 400 and 500. However, the customer can easily remove the sliding digit 300 in the above-described manner for repair purposes.

Furthermore, each display module 100 is designed to be spacedly apart from each other as shown in FIG. 12. Each module 100, as previously described, is affixedly attached to the wall 20 by means of the mounting brackets and UNISTRUT channels. Hence, each module 100 can be independently removed from the system 10 without the necessity of disturbing the other modules 100.

The display holder 120 slidably engages channel 1214 of module 100 and is firmly held in a vertical position thereby. Hence, it can be readily seen that each display sign can be independently and rigidly mounted to a module 100 without the use of tools or the like and when it is desirable to use a display sign 120 it can be quickly and easily inserted into the provided channel 1214.

Figure 13:
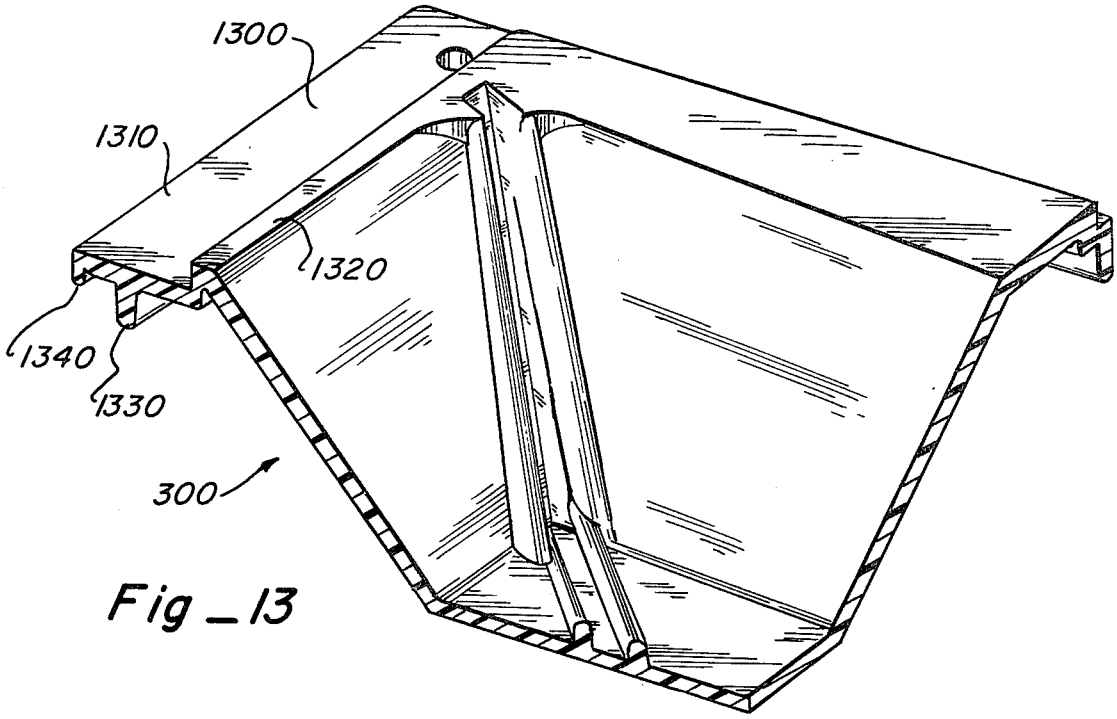
FIG. 13 is a corner cross section of the sliding digit panel.

In FIG. 13 is shown the corner of a sliding digit panel 300 in section. An outwardly extending lip 1300 is found at both the upper and lower edges of the sliding digit 300. Lip 1300 engages the channels 1040 of the frame 1000. Lip 1300 has a flat front surface 1310 which is inwardly offset from the front surface 1320 of the digit. On the inner surface opposing the front surface 1310 is a perdendicular ridge 1330 disposed midway thereon and a second parallel ridge 1340 which is substantially lower in height than ridge 1330.

Figure 14:
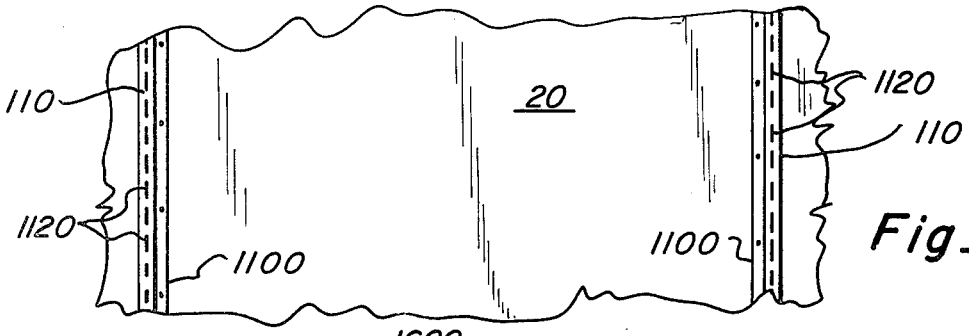
FIG. 14 is an illustration setting forth the orientation of the wall supports.
Figure 15:
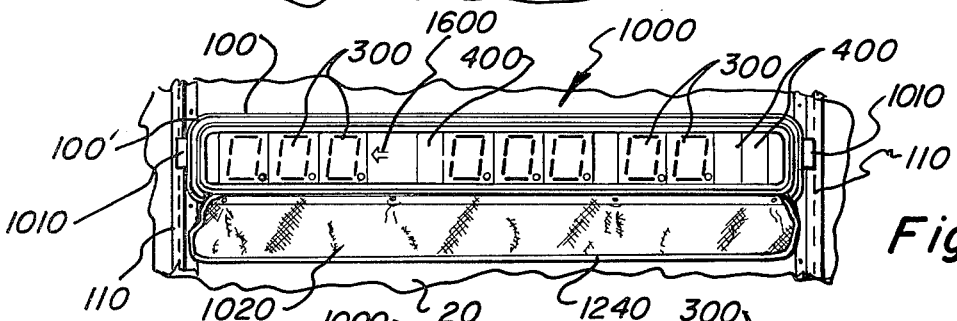
FIG. 15 is an illustration setting forth the mounting of a module to the wall supports of FIG. 14.
Figure 16:
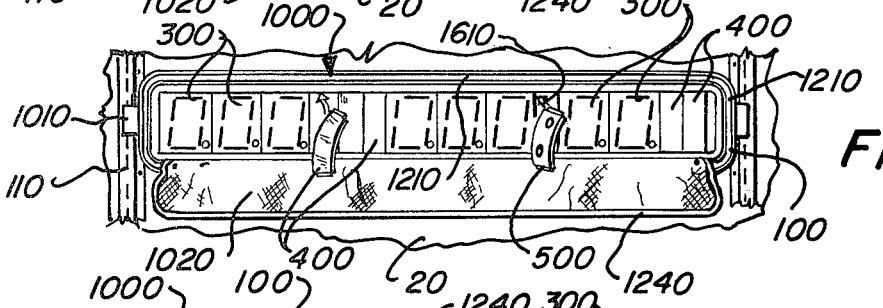
FIG. 16 is an illustration of inserting a spacer sliding panel into a mounted module.

In FIGS. 14–17, the step-by-step method of modifying the display 10 of the present invention is set forth. As priorly stated, and as shown in FIG. 14, the UNISTRUT panels 110 have been mounted to a wall 20. A display module 100 of the present invention is mounted to the UNISTRUT panels 110, as shown in FIG. 15, by engaging the bracket clips 1110 into slots 1120. A blank panel 400 is inserted in the direction of arrow 1600 by compressing the flexible panel in the manner shown.

Figure 17:
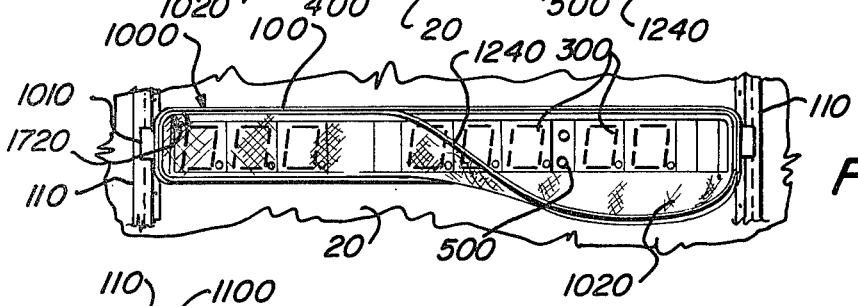
FIG. 17 is an illustration setting forth the insertion of a contrast screen over the sliding digit in a module.
Figure 18:
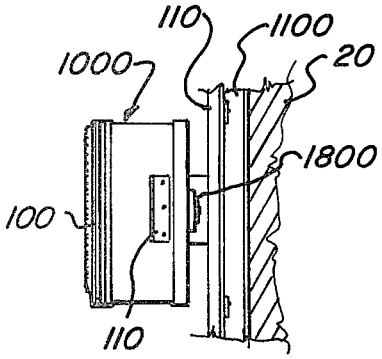
FIG. 18 is a side view of a mounted module detailing the thumbwheel switch.

Once the spacer and colon panels 400 and 500 are inserted in the channels 1040, the contrast screen 1020 can be inserted by pressing the insert material 1240 into channel 1210 as shown in FIG. 17 by arrow 1700. Finally, the display panel 100 is electronically modified to conform to the configuration of the sliding digits 300 through proper selection of a position on dial switch 1800 as shown in FIG. 18 which will be subsequently discussed.

Figure 19:
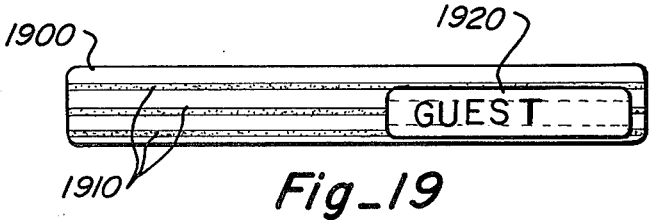
FIG. 19 is a front planar view of a display sign of the present invention.
Figure 20:
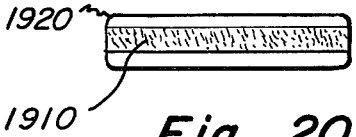
FIG. 20 is a front planar view of a sign of the present invention.

In FIGS. 19 and 20 are shown the details of the display sign 120. The sign 120 is made from a black rigid plastic material having rows of parallel VELCRO strips 1910 affixed thereto on one surface. Individual signs 1920 can be constructed bearing any labeling for any sport on smaller plastic shapes. Signs 1920 also have VELCRO strips 1910 affixed to the rear surface of the sign. Hence, any convenient display sign 120 can be readily constructed and modified.

Figures 21, 22:
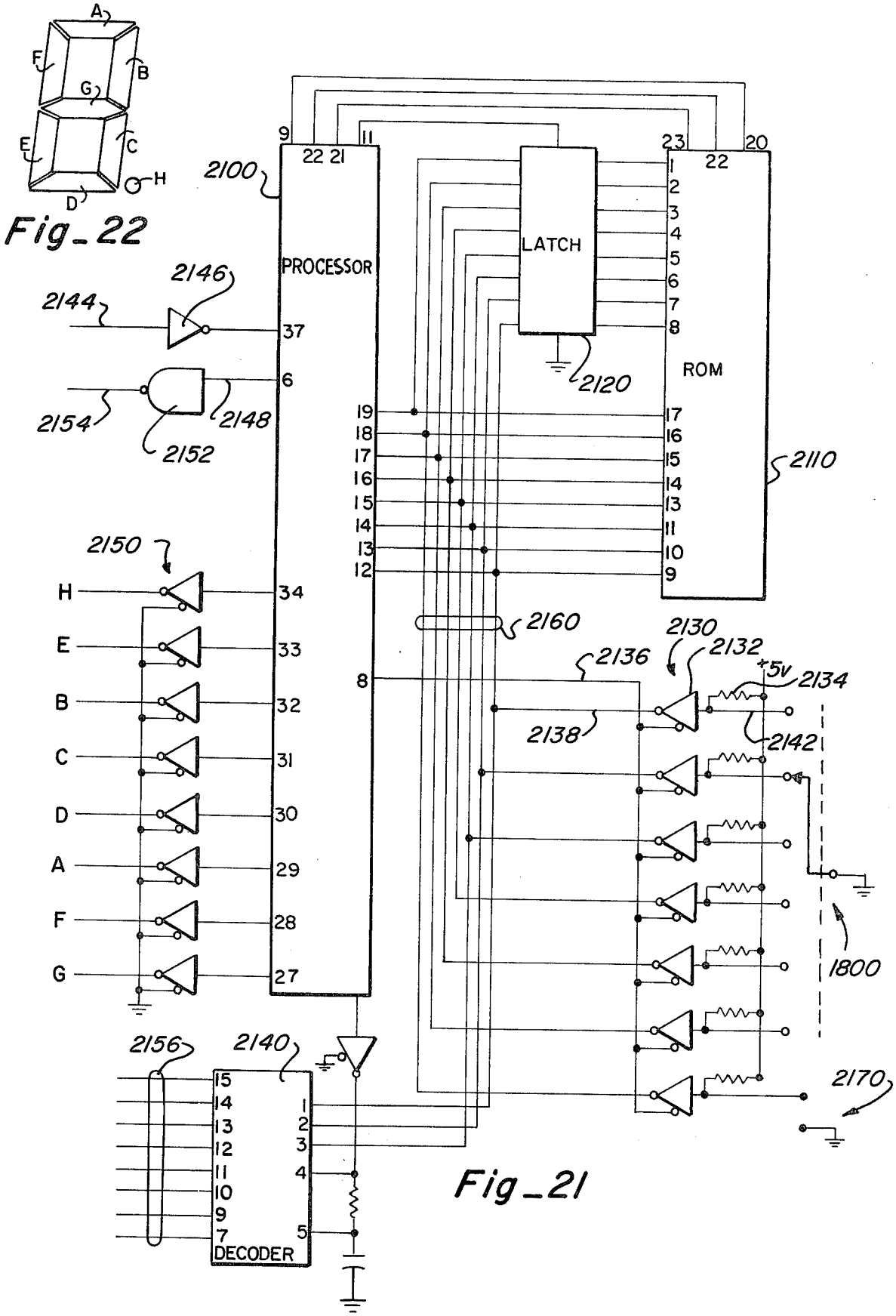
FIG. 21 is a schematic of the electronics found in each module of the present invention.
FIG. 22 is a representation of the identity of the segments found on a display panel.

The control electronics for each module 100 are shown in schematic form in FIG. 21 to include a processor 2100, a Read Only Memory 2110, a latch address register 2120, input buffers 2130, an output decoder 2140, and output buffers 2150.

A mechanical thumbwheel switch 1800 is shown connected to ground to be capable of tapping in conventional form a number of tri-state devices commonly designated as 2132. Each tri-state device 2132 is biased through resistor 2134 to a positive five volt DC source, Furthermore, each tri-state device 2132 receives an enable signal over lead 2136 from processor 2100. An output is delivered onto lead 2138 only when the input on lead 2142 is grounded from the mechanical switch 1800 and an enable signal is present on lead 2136. The input buffers 2130 provide a unique signal on bus 2160 which bus intercommunicates with the processor 2100, the latch 2120, the ROM 2110, and the decoder 2140.

The thumbwheel switch 1800 and the input buffer 2130 serve the following important role, As previously mentioned, whenever the module 100 is desired to be reconfigured to a new configuration or arrangement, the thumbwheel switch 1800 is set to correspond to a new configuration on a modified presentation of the source configuration. In other words, the customer receives a table setting forth the available predetermined patterns in which a module can be configured into as well as the corresponding thumbwheel switch elections corresponding to an individual pattern. The following table sets forth an example:

| Configuration | | | Thumbwheel Setting |
|---|---|---|---|
| LN | PL | TIME | |
| 1 | 0 | 00:00.00 | 1 |
| 2 | 0 | 00:00.00 | 2 |
| 3 | 0 | 00:00.00 | 3 |
| 4 | 0 | 00:00.00 | 4 |
| 5 | 0 | 00:00.00 | 5 |
| 6 | 0 | 00:00.00 | 6 |
| 7 | 0 | 00:00.00 | 7 |
| 8 | 0 | 00:00.00 | 8 |
| 9 | 0 | 00:00.00 | 9 |
| 10 | 0 | 00:00.00 | A |
| Lengths | | Record | B |
| 00 | | 00:00.00 | |
| Event | | Heat | C |

-continued

| Configuration | | | Thumbwheel Setting |
|---|---|---|---|
| 000 | | 000 | |
| HOME | GUEST | GUEST | D |
| 000 | 00 | 000 | |
| | LN | | E |
| | 1 2 3 4 5 6 7 8 | | |
| | 0 0 0 0 0 0 0 0 | | |

The information entered into the input buffers 2130 based upon the position of the thumbwheel switch serves as a unique address defining the module pattern configuration. Hence, the data delivered from the transmitter 40 is initially identified by the address appearing in the input buffers 2130. The data from the transmitter 40 is conventionally received by receiver, not shown, and is delivered over lead 2144 through buffer 2146 into the processor 2100. The processor initially receives the address data from the transmitted information appearing on lead 2144 and compares it with the address appearing in the buffers 2130. If a mis-match occurs, the processor sends the data out over lead 2148 through a buffer 2152 and over lead 2154 which is interconnected with the next module over that module's lead 2144. Hence, a daisy-chain interconnection occurs between individual modules on leads 2144 and 2154. The data transmitted from transmitter 40 is handed off to each module until finding a module having a configuration as defined by thumbwheel switch 1800 for which the transmitted data is compatible therewith. In the event that the transmitted address appearing in buffers 2130, the processor processes the ensuing transmitted data.

The ensuing data, of course, relates to which digits of the module are to be lit and in what pattern they are to be lit. Hence, the selection of the proper digit, and there are eight digits, occurs with the output decoder 2140 which receives a three-bit binary input from the bus 2160 and converts that information to a one out of eight output appearing on leads 2156. Hence, the processor 2100 can quickly activate the proper sliding digit 300 for display purposes. The pattern which the individual selected display digits 300 is to have is determined by output buffers 2150 which are also tri-state devices which, however, are grounded. The outputs of the buffers 2150 are designated with alpha characters which correspond to the various segments of a digit display shown in FIG. 22.

It is to be noted that no signal is provided for a colon. The colon is activated in the following manner. When the colon panel 500 is inserted into the frame 1000, a plug, not shown, is provided which plugs into an adjacent digit panel. This plug-in arrangement overrides the period 320 on the sliding digit 300. Hence, whenever lead H is activated, and a colon panel 500 is inserted into the adjacent sliding digit, activation on lead H to that sliding digit rather than activating the period 320, activates the colon 500.

It can therefore be seen that with proper conventional programming, which is not a subject of this invention, the processor by receiving information over lead 2144 can select a proper sliding digit 300 by means of leads 2156 and thereupon activate appropriate segments of that display by means of buffers 2150. The processor is provided with a conventional read only memory 21 and addressed the read only memory 2110 by means of a latch register 2120 and receives data from the read only memory 2110 over bus 2160.

Additionally, a test switch 2170 is provided which activates a tri-state buffer 2130 in the manner previously discussed to signal the processor 2100 to ignore date appearing on lead 2144 and to enter into a self-test routine whereby the sliding digits displayed predetermined patterns of the information. Hence, should the customer believe the module 100 to be defective, by activating switch 2170, the processor based upon the dialed-in code on thumbwheel 1800 can go through a plurality of self-test programs (a different program for each switch position of switch 1800) to completely diagnose the module 100. In the event that a sliding digit is defective, or a colon is defective, as previously discussed, such defective components can be easily and quickly removed and replaced with a spare without jeopardizing the integrity of the overall module 100 or system 10.

Although the above has been described in detail for use in a swimming environment, it is to be expressly understood that under the teaching of the present invention, the display modules and display signs can be readily reconfigured and changed to be compatible with other applications such as basketball, wrestling, football, classroom, and commercial setting, etc. Furthermore, although the use of a thumbwheel switch has been expressly delineated, it is clear that other input devices such as keyboards, mechanical switches, or the like can also be utilized. Furthermore, although a radio transmitter and a radio receiver is disclosed, it is to be understood that a cable can be utilized in a conventional fashion to eliminate the need for a transmitter and receiver to interconnect the display with the sensors. Furthermore, although a UNISTRUT channel has been utilized to mount the display system to a wall, other conventional mounting techniques can also be utilized.

The above-described invention being adaptable to a nunber of different sports can be utilized effectively by a school system as follows. Each school in the system can utilize a certain number of display signs and modules of the present invention for a number of different sports. However, at annular meets, the schools can each bring their display signs and display modules and can construct large scoreboard display systems at virtually no additional hardware cost to the school system.

Furthermore, a particular school can easily expand its system should it desire at a minimum cost.

Hence, although a particular structural approach has been shown, it is believed that a breakthrough has occurred in the design of sports scoreboard systems adaptable to a variety of sports and to a variety of applications. Furthermore, the teachings of the present invention are not to be limited to sports display devices, rather, the invention can be adapted to a variety of applications including classroom teaching applications, auction applications, commercial advertising, etc. Therefore, it is to be expressly understood that the present disclosure has been made by way of example, and that changes in detail of the structure may be made without departing from the spirit thereof.

We claim:

1. An improved multifunction modular scoreboard display system mounted on a wall for displaying lighted information based upon data signals received from a location remote from said display system, the front of said display system displaying said information, said improved system comprising:

a plurality of mount brackets affixed to said wall, a plurality of rectangular display modules having upper and lower elongated ends, a plurality of panels, some of said panels being capable of being activated to produce a lighted information display, and some of said panels being spacers, each of said panels having upper and lower horizontal lips, means on said upper and lower elongated ends of each of said rectangular display modules for receiving said lips of said panels by insertion of said panels, in a direction from said front of said display system, into said display module, each of said panels when inserted being capable of sliding, horizontally in said receiving means, to any desired horizontal location in said display module, said inserted panels being capable of selective removal, in a direction from said front at said desired horizontal location, from said receiving means, means for releasably mounting, in a direction from said front of said system, each of said display modules to said mount brackets in horizontal spaced relationship to each other whereby any given display module can be removed from said brackets without removing any other display module and without removing said inserted panels received in said given display module, and means receptive of said data signals and contained in each of said display modules and releasably interconnected with each of said inserted display panels at said desired horizontal location for selectively activating said display panels to produce said lighted information, said activating means changing said lighted information as said data signals change.

2. An improved multifunction modular scoreboard display system mounted on a wall for displaying lighted information based upon data signals received from a location remote from said display system, the front of said display system displaying said information, said improved system comprising:

a plurality of mount brackets affixed to said wall, a plurality of rectangular display modules having upper and lower horiziontal elongated ends, a plurality of panels, some of said panels being capable of being activated to produce a lighted information display and some of said panels being spacers, each of said panels having upper and lower horizontal lips, means on said upper and lower horizontal elongated ends of each of said rectangular display modules for receiving said lips of said panels by insertion of said panels, in a direction from said front of said display system, into said display module, each of said panels when inserted being capable of sliding, horizontally in said receiving means, to any desired horizontal location in said display module, said inserted panels being capable of selective removal, in a direction from said front at said desired horizontal location, from said receiving means, means for releasably mounting, in a direction from said front of said system, each of said display modules to said mount brackets in horizontal spaced relationship to each other whereby any given display module can be removed from said brackets without removing any other display module and without removing said inserted panels received in said given display module, a plurality of rectangular display signs carrying a plurality of individual signs for providing identification information, each of said display signs having upper and lower horizontal elongated edges, each of said individual signs being selectively affixed, in a direction from said front of said display system, at any desired horizontal position on said display sign, and means on said upper and lower horizontal elongated ends, located beyond said receiving means and closer to the aforesaid ends, of each of said display modules for supporting one horizontal elongated edge of a display sign above a display module or between a pair of said display modules, said plurality of display modules being mounted to said mount brackets in a predetermined order wherein said plurality of display signs are selectively inserted in said supporting means so that the inserted display panels in the display modules mounted directly below each of the aforesaid display signs are identified.

3. The improved multifunction scoreboard of claim 2 further comprising:

means receptive of said data signals and contained in each of said display modules and releasably interconnected with each of said inserted display panels at said desired horizontal location for selectively activating said inserted display panels to produce said lighted information, said activating means changing said lighted information as said data signals change.

4. An improved multifunction modular scoreboard display system mounted on a wall for displaying lighted information activated by data received from a location remote from said display system, the front of said display system displaying said lighted information, said display system having a receiver for receiving said data, said improved system comprising:

a plurality of rectangular display modules having upper and lower elongated ends, a plurality of panels, some of said panels containing displays which are capable of being selectively activated to produce lighted information, and some of said insertable panels being spacers, each of said panels having upper and lower horizontal lips, each of the aforesaid display panels containing means for producing said lighted information from with the aforesaid panels, means on said upper and lower elongated ends of each of said rectangular display modules for receiving said lips of said panels by insertion of said panels, in a direction from said front of said display system, into said display module; each of said panels when inserted being capable of sliding, horizontally in said receiving means, to any desired horizontal location in said display module; each of said inserted panels being capable of selective removal from said front, at said desired horizontal location, from said receiving means, means in each of said rectangular display modules for controlling the activation of said producing means in each of said inserted display panels contained in the aforesaid display module, the producing means in each of said inserted display panels being releasably interconnected with said controlling means, each of said inserted panels being arranged in said display module and interconnected to said controlling means in a plurality of different patterns, means for electrically connecting the controlling means of each display module together, and means in one of said plurality of rectangular display modules for receiving said data from said receiver and for comparing an address contained in said data to a unique module address identifying said display module, when said address is identical to said module address said comparing means extending the ensuing portion of said data to said controlling means for activation of said producing means, said lighted information from said inserted display panels arranged in said pattern being activated and deactivated by said ensuing portion of said data, when said address is different than said module address said comparing means extending said data over said connecting means to the comparing means on the next rectangular display module.

5. The improved system of claim 4 further comprising:

means in each of said controlling means for switching the aforesaid control means to control one of said patterns of inserted display panels in the module, said switching means having a unique setting corresponding to each of said patterns.

6. An improved multifunction modular scoreboard display system for displaying lighted information activated by data received from a location remote from said display system, the front of said display system displaying said lighted information, said display system having a receiver for receiving said data, said improved system comprising:

at least one display module, a plurality of panels, some of said panels containing displays which are capable of being selectively activated to produce lighted information, and some of said panels being spacers, each of the aforesaid display panels containing means for producing said lighted information from within the aforesaid panels, means on said display module for receiving said panels by insertion of said panels into said display modules at a desired horizontal location in said display module; each of said inserted panels being further capable of selective removal from said receiving means at said desired location; said inserted panels being arranged in said display module and interconnected to said controlling means in one of a plurality of different patterns, means in said display module for controlling the activation of said producing means in each of the display panels inserted in said display module, the producing means in each of said inserted display panels being releasably interconnected with said controlling means, means in said display module for receiving said data from said receiver and for comparing an address contained in said data to a unique display module address identifying said display module, when said address is identical to said module address said comparing means extending the ensuing portion of said data to said controlling means for activation of said producing means, means in said controlling means for switching the aforesaid control means to control the selective activation of said inserted display panels arranged in one of said patterns, said switching means having a different setting corresponding to each of said different patterns so that when said data is received by said comparing means and extended to said controlling means for selective activation of each of said producing means contained in each inserted display panel said lighted information is produced in said one pattern, said lighted information being selectively activated and deactivated by said ensuing data.

* * * * *